US005091732A

United States Patent [19]

Mileski et al.

[11] Patent Number: 5,091,732

[45] Date of Patent: Feb. 25, 1992

[54] LIGHTWEIGHT DEPLOYABLE ANTENNA SYSTEM

[75] Inventors: Paul Mileski; Jeffrey Kornblith, both of Mystic, Conn.

[73] Assignee: The United States of America as represented by the Secretary of the Navy, Washington, D.C.

[21] Appl. No.: 579,455

[22] Filed: Sep. 7, 1990

[51] Int. Cl.[5] ..... H01Q 21/260; H01Q 1/340; H01Q 9/160

[52] U.S. Cl. ..... 343/797; 343/709; 343/821; 333/26

[58] Field of Search ..... 343/915, DIG. 2, 874, 343/877, 878, 880, 881, 884, 888, 889, 705, 709, 749, 793, 797, 805, 820–822, 862, 864, 865, 853; 333/26

[56] References Cited

U.S. PATENT DOCUMENTS

| | | | |
|---|---|---|---|
| 2,673,295 | 3/1954 | Wentworth | 343/805 |
| 3,158,865 | 11/1964 | McCorkle | 343/709 |
| 3,702,479 | 11/1972 | Uhrig | 343/797 |
| 4,115,784 | 9/1978 | Schwerdtfeger et al. | 343/DIG. 2 |
| 4,475,109 | 10/1984 | Dumas et al. | 343/709 |
| 4,593,290 | 6/1986 | Wojtowicz | 343/709 |
| 4,977,408 | 12/1990 | Harper et al. | 343/880 |

*Primary Examiner*—Michael C. Wimer

*Assistant Examiner*—Peter Toby Brown

*Attorney, Agent, or Firm*—Michael J. McGowan; Prithvi C. Lall; Michael F. Oglo

[57] ABSTRACT

A deployable antenna assembly includes a canister providing an elongated chamber and an elongated hollow mast with a mounting member on its upper end. A coaxial cable extends into the hollow mast to provide radio signals to the antenna assembly and four antenna members of resiliently deflectable wire spaced at 90 degrees intervals about the periphery of the mounting plate comprise a generally helical coil and elongate arms extending downwardly along the inner wall of the canister, and each opposed pair comprises a dipoles. A pair of baluns are connected to the coaxial cable and disposed adjacent the mounting member, and a phase shifter are connected between the coaxial cable and one of the baluns. Connectors conductively connect the central conductor of the balun to the coil of one of the antenna members of a dipole, and the conductive shield to the coil of the other antenna member of a dipole. A sealing medium is provided about the baluns, and phase shifter. The coils of the antenna members are flexed when the arms are the downwardly extending position within the canister, and the canister is slidable relative to the mast and antenna members to free the arms therefrom for extension into a horizontal position.

18 Claims, 3 Drawing Sheets

LIGHTWEIGHT DEPLOYABLE ANTENNA SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to antenna systems and, more particularly, to deployable antenna assemblies suitable for use in marine, space and other environments.

Underwater installations and submersible vehicles occasionally require antennas above the surface of the water for transmission of radio signals to other installations and vessels.

Space applications similarly may require compact deployable antenna systems. Field applications of the military rescue units, explorers and the like also require compact antenna assemblies for ready transport and rapid deployment.

A number of designs have been developed for antenna packages for marine applications which permit deployment of an antenna when the package is at the surface. When there is an ice pack or an ice layer over the surface of the water, it is also required that the antenna assembly or its package be able to penetrate that covering so that it may be deployed thereabove, and various types of devices are employed in connection with deployable antenna assemblies to effect such penetration.

Deployable antenna systems for marine applications currently used in the field are either inflatable or suitcase models. The inflatable type houses the antenna components within a bag which must be inflated when the antenna is ready to be used, and it employs a carbon dioxide system to effect such inflation. In applications where weight may be a critical factor to the antenna assembly, the added weight of the carbon dioxide cylinder in the system may render the system too heavy for some applications. Moreover, once inflated, the elements of the antenna system are severely distorted when subjected to high levels of wind loading.

The suitcase models present problems from the standpoint of use in some applications and environments because of the size and weight of the "suitcase" which houses the antenna elements as well as the cumbersome multi-step process which is required to deploy the antenna system.

Similarly, some of the deployable antenna assemblies for use in space and field applications are complex and costly, or require relatively complex steps.

It is an object of the present invention to provide a novel deployable antenna assembly which is compact and relatively easy to deploy either by hand or remotely in a single step.

It is also an object to provide such an antenna assembly which may be fabricated from readily available components to provide an omnidirectional antenna which will exhibit a reasonably useful lifespan in a marine or other hostile environment.

Another object is to provide such an antenna assembly which has a relatively narrow profile so as to be reasonably stable in relatively high winds.

SUMMARY OF THE INVENTION

It has now been found that the foregoing and related objects may be readily attained in a deployable antenna assembly which has a canister providing an elongated chamber and an elongated hollow mast extending within the chamber with its upper end spaced below the upper end of the canister. A mounting member is provided on the upper end of the mast, and a coaxial cable extends within the hollow mast to provide radio signals to the antenna assembly. Spaced at 90° intervals about the periphery of the mounting member are four antenna members of resiliently deflectable wire, each comprising a generally helical coil mounted on the mounting member and elongate arms extending downwardly along the periphery of the mounting member and along the inner wall of the canister, and the opposed pairs comprise dipoles.

A pair of baluns is connected to the coaxial cable and disposed adjacent the mounting member, and a phase shifter is connected between the coaxial cable and one of the baluns. First connectors conductively connect the central conductor of a balun to the coil of one of the antenna members of a dipole, and second connectors conductively connect the conductive shield of a balun to the coil of the other antenna member of a dipole. A sealing medium is provided about the baluns, phase shifter and connectors. The coils of the antenna members are flexed when the arms are in the downwardly extending position within the canister, and the canister being slidable relative to the mast and antenna members to free the arms therefrom for extension into a horizontal position.

In its preferred embodiment, each of the baluns comprises a core conductor, an insulating layer, a conductive shield, an insulating layer, and an outer conductive layer extending over a portion of the length thereof. The outer conductive layer is conductively bonded to the conductive shield at a point spaced from the feed to the shield a distance equivalent to about 1/4 the effective wavelength for the intended radio transmissions.

Preferably, the antenna assembly includes canister removal means for projecting the canister upwardly to release the antenna arms for movement into the horizontal position, and this comprises a discharge element within the canister actuatable upon receipt of a signal, and a signal conductor connected thereto. The sealing means includes a substantially impervious synthetic resin coating about the several elements, and the baluns are supported from the mounting member.

Desirably, the conductive shield of the baluns is secured to the mounting member, and the mounting member has apertures therein providing passages for the connectors. The apertures have a metallic surface thereabout and the core conductor and conductive shield of the baluns are connected thereto and connectors extend therefrom to the coils. Preferably, the baluns include a coaxial cable in which the conductive shield is a tubular metallic element extending thereabout, the second conductive layer is a metallic tape spaced from the tubular metallic element by an insulating sleeve. The phase shifter is also a length of coaxial cable but disposed in a U-shaped configuration.

DETAILED DESCRIPTION OF PREFERRED EMBODIMENT

Figure 1:
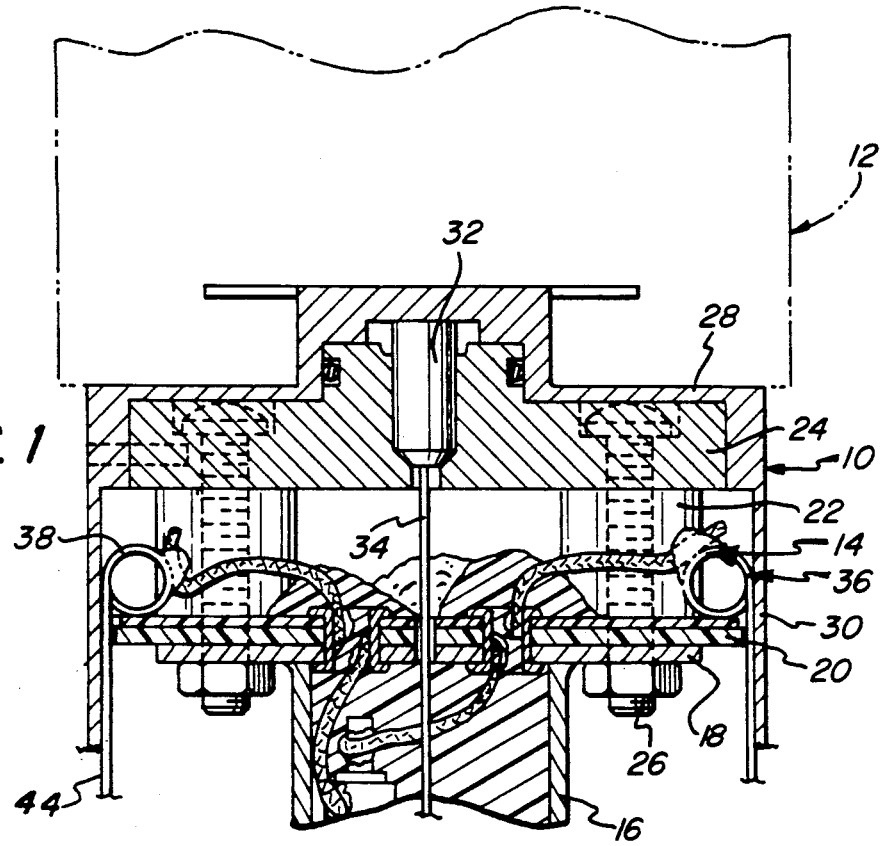
FIG. 1 is a fragmentary sectional view of the portion of a deployable antenna assembly containing the bulk of the operating components.

Turning first to FIG. 1, therein fragmentarily illustrated is a deployable antenna assembly for marine applications which embodies the present invention and is comprised of a tubular canister generally designated by the numeral 10 with a closed top end wall or cap 28 above which is disposed a penetrator generally designated by the numeral 12 and illustrated in phantom line. The antenna assembly generally designated by the numeral 14 is disposed within the canister 10 and includes an elongated cylindrical mast 16 having a top plate 18 extending across its upper end upon which is supported the mounting member 20.

Extending between the cap 24 which bears against the end cap 28, and the mounting member 20 are spacers 22, and fasteners 26 maintaining the elements in assembly. As seen in FIG. 1, the canister 10 is comprised of the cap 24 and the tubular body 30.

Seated in a coaxial cavity in the cap 24 is a discharge element 32 which is actuatable by a signal transmitted thereto through the conductor 34.

Figure 2:
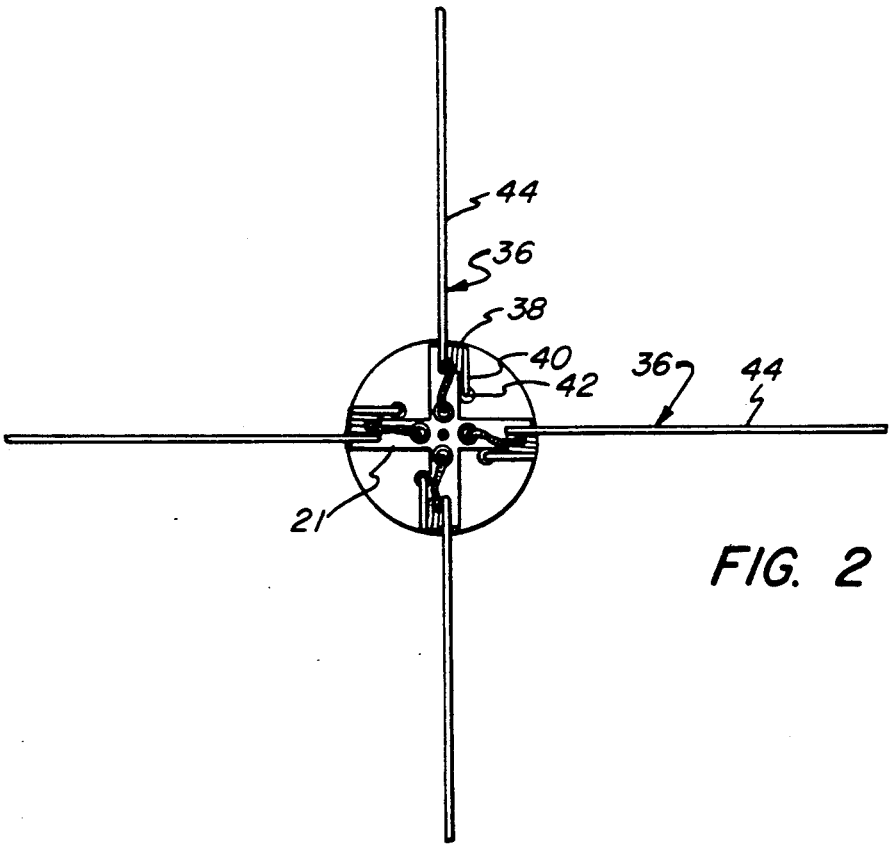
FIG. 2 is a plan view of the antenna assembly following deployment.

As seen in FIGS. 1 and 2, four antenna elements generally designated by the numeral 36 are spaced about the periphery of the mounting member 20 at 90° intervals, and each comprises a length of resiliently deflectable wire formed into a helical coil 38 with a tail 40 extending from one end thereof which is bonded to the mounting member by adhesive or resin as indicated by the numeral 42. Extending from the opposite end of the coil 38 is an elongated arm 44 which, when the antenna elements 36 are unrestrained, will extend in a horizontal plane as indioated in FIG. 2.

In FIG. 1, the arms 44 are deflected downwardly and flex the coil spring 38, and they resiliently bear against inner wall of the tubular body 30 of the canister 10. As best seen in FIG. 2, the mounting member 20 may include a cruciform element 21 on its upper surface.

Figure 4:
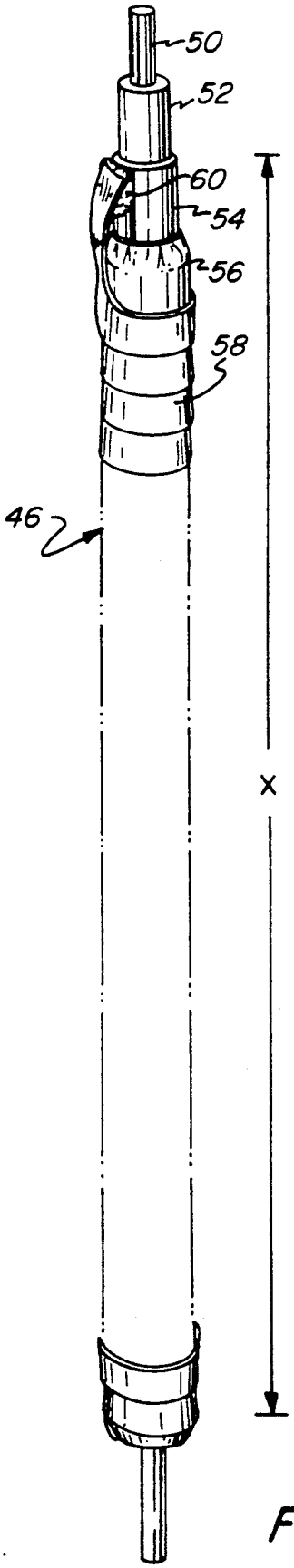
FIG. 4 is an elevational view of a balun used in the present invention.

Turning now to FIG. 4, therein illustrated is a balun generally designated by the numeral 46 and utilized in the present invention. It is comprised of a conductive core 50, an insulating layer 52 thereabout, a tubular copper element 54 functioning as a conductive shield, a length of plastic sheath or tubing 56 tightly seated thereabout, and conductive copper tape 58 wound thereabout over a predetermined length of the balun. As indicated by the numeral 60, the copper tape is conductively bonded to the copper tubing 54 at a point spaced a distance X from the feed into the balun as will be described more fully hereinafter.

Figure 3:
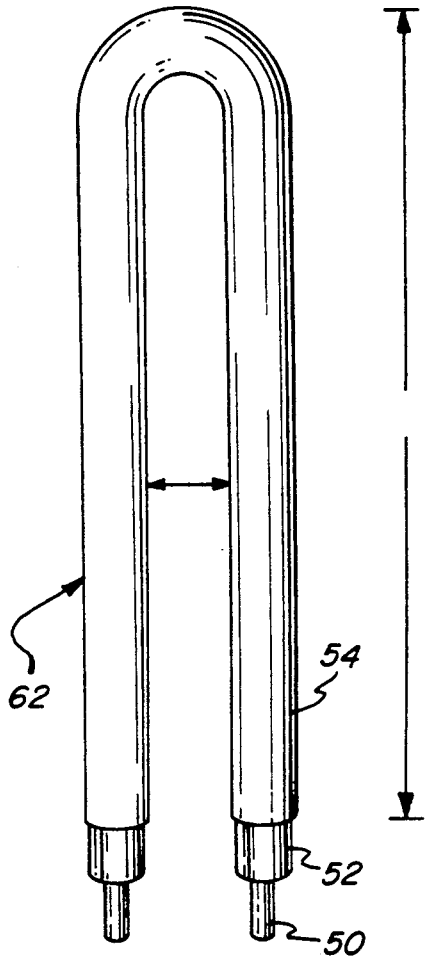
FIG. 3 is a side elevational view of a phase shifter utilized in the antenna assembly of the present invention.

In FIG. 3 there is illustrated a phase shifter 62 utilized in the present invention and it conveniently comprises a length of the coaxial cable utilized in the balun of FIG. 3 (except that the insulating tubing 56 and copper tape 58 are omitted), and it is formed into a U-shaped configuration.

Figure 5:
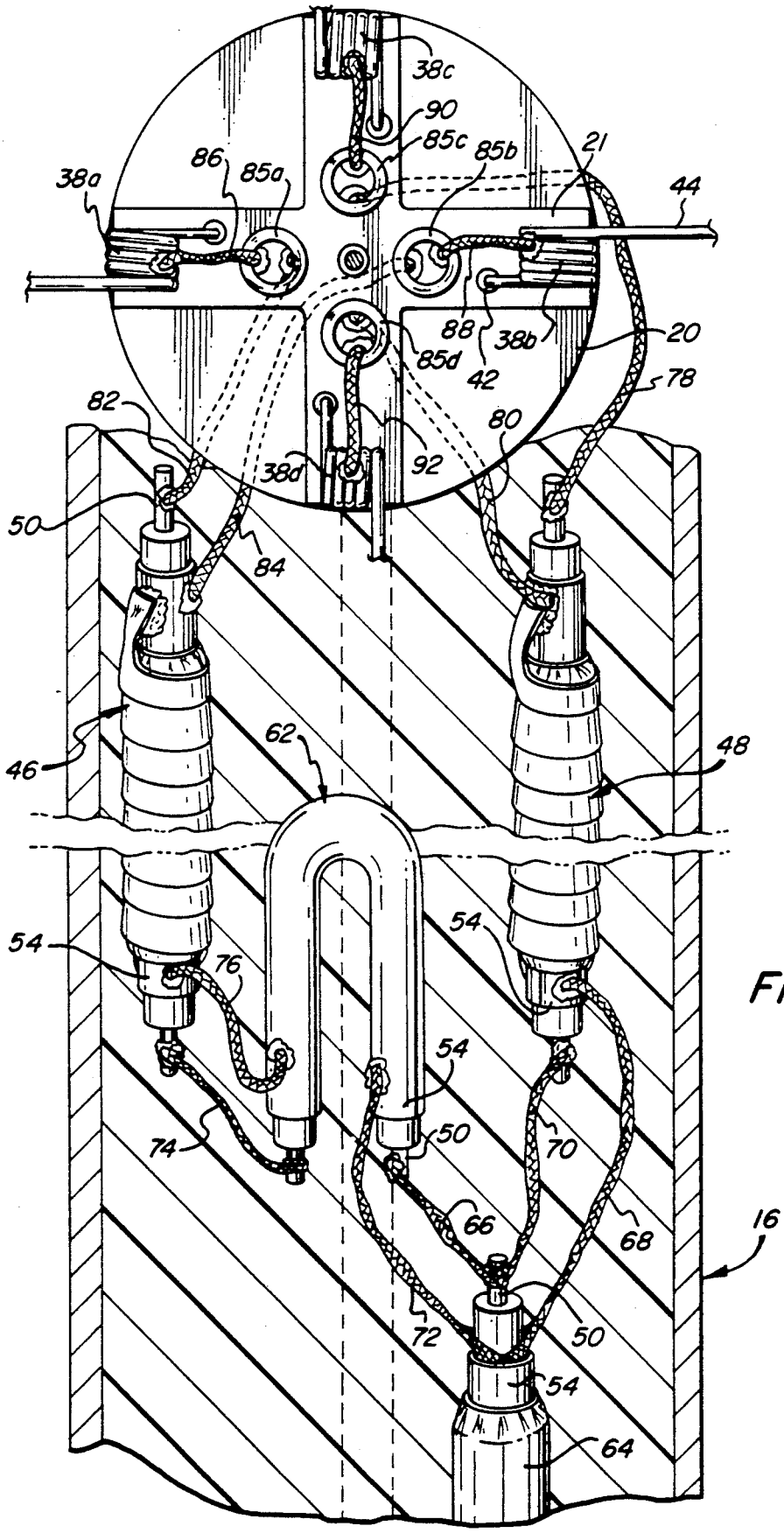
FIG. 5 is a partially schematic view showing the assemblage of electrical components in the antenna assembly.

Turning now to FIG. 5, therein illustrated diagrammatically are the electrical components of the deployable antenna assembly showing the manner in which they are connected to each other. At the lower end of FIG. 5, there can be seen the fragmentarily illustrated coaxial cable 64 which is delivering the radio signal to the antenna assembly. From its conductive core 50 extend the leads 66 and 70 respectively to the conductive core 50 of the balun 48 and of the phase shifter 62. From the conductive shield 54 of the coaxial cable 64 extend the leads 68 and 72 to the conductive shield 54 of the balun 48 and of phase shifter 62. In turn, the leads 74 and 76 extend from the conductive core 50 and conductive shield 54 of the phase shifter 62 to the conductive core and conductive shield of the balun 46.

Extending from the opposite end of the balun 46 are leads 82, 84 which are conductively bonded to terminals 85*a* and 85*b* on the cruciform element 21 of the mounting member 20. Leads 78 and 80 from the balun 48 are in turn bonded to the terminals 85*c* and 85*d*.

Extending from the terminals 85*a* and 85*b* are leads 86 and 88 which extend to the coils 38*a* and 38*b* of the opposed antenna elements which form a dipole. Similarily, leads 90 and 92 extend from the terminals 85*c* and 85*d* to the coils 38*c* and 38*d* of the antenna elements providing the other dipole.

As diagrammatically illustrated in FIGS. 1 and 5, the baluns 46, 48 and phase shifter 62 and the connections to the coaxial cable 64 are potted in a synthetic resin to provide a water tight seal about them and their leads. In addition, as seen in FIG. 1, synthetic resin material is deposited about the ends of the leads and the terminals 85 to provide a seal thereabout.

Upon actuation of the discharge element 32 as a result of a signal transmitted through the conductor 34, the penetrator 12 and the canister 10 are pushed upwardly and free from engagement with the antenna assembly 14. At this point, the arms 44 of the antenna elements 36 spring outwardly into a horizontal position as a result of the torsion in the coils 38.

As previously indicated, the antenna 14 comprises a pair of dipole antennas which are oriented 90 degrees apart in a common horizontal plane and each of the dipoles is fed with a sleeve type balun to ensure balanced element feed point current thereto. The baluns in turn are fed in phase quadrature (a relative phase difference of 90° as a result of the phase shifter 62) so that the resulting overhead radiation is right hand circular polarized (RHCP). As will be appreciated, the phase quadrature employed in the present invention results in the dipole antenna being nearly omnidirectional with the wave from the back side of the antenna, i.e., towards the water or ice, being cross polarized with respect to the skyward wave.

To reduce the size of the antenna elements 36, the arms 44 are less than ¼ wave length and are tuned to resonance by using approximately 0.75 turn of the coil 38 as a series inductor at the feed point. The antenna elements are desirably fabricated from phosphor bronze wire to improve their corrosion resistance while providing a reasonable compromise among modulus, spring retention, conductivity, and the ability to be wet with solder. In one embodiment which has been field tested satisfactorily, the wire had a thickness of about 0.045 inch diameter.

To provide good conductivity and resistance to corrosion, the leads from the terminals to the coils are desirably provided by silver plated copper braid. If so desired, the core and a portion of the conductive shield can be used to provide the lead to the terminals from the baluns.

Sleeve type baluns were chosen for the antenna assembly of the present invention because of their low loss and their compatibility with the hollow mast structure. The relatively low bandwidth of this type balun (approximately 5 MHz) is easily accommodated in a single frequency application.

As indicated, the baluns are each constructed using a semi-rigid coaxial cable, preferably about 0.085 inch outside diameter, having a tubular copper sleeve as the shield and providing the semi-rigidity. A length of this cable is coated with heat shrink tubing and then covered with copper tape over a length which is then bonded or soldered to the copper tubular sleeve at a point which is a distance of approximately ¼ of the effective wave length away from the feed to the balun. The copper tape and the semi-rigid cable sleeve serve as the outer and inner conductor respectively of a coaxial sleeve balun. The non-shorted end of the balun is trimmed until the antenna-feed presents an open circuit to the undesirable unbalanced currents; the correct tuning may be verified using an impedance analyzer.

Other types of insulating medium between the copper tape and the copper tubing representing the outer conductor or shield of the coaxial cable may also be employed. Although the heat shrink tubing is not a perfect dielectric, the impedance of the balun to the flow of unbalanced currents, which varies from 300–500 ohms, is sufficient.

As previously indicated, the proper phase relationship between the dipoles is maintained by delaying the phase of the one dipole through a quarter wave length of semi-rigid coaxial cable similar to that employed for the baluns. The loop is formed and retained next to the balun in order to minimize the electronic package.

The antenna feed is conveniently provided by a low loss teflon dielectric flexible coaxial cable which has its outer jacket etched prior to potting of the baluns and phase shifter to ensure proper adhesion of the epoxy potting compound to it as well as to the other components.

In use of the antenna assembly, it is directed to the surface from an underwater vehicle or facility. The penetrator shown in FIG. 1 effects penetration through any surface ice, after which the discharge element is actuated to propel from the antenna assembly the penetrator and the canister. This frees the antenna arms to effect their deployment. A buoy (not shown) maintains the antenna mast in an elevated position relative to the environment so that the antenna elements are spaced above the water or surrounding ice pack. The relatively compact profile of the antenna assembly provides reasonable stability, even in high wind speeds of 70 miles per hour.

Thus, it can be seen that the antenna assembly of the present invention is one which is readily deployable from its storage condition to its operative position. The components are relatively simple and economical to fabricate and the components, when assembled, are relatively protected from the hostile marine environment to enable use for a reasonable working period without substantial loss in efficiency.

What is claimed is:

1. A deployable antenna assembly comprising:

a canister providing an elongated chamber therewithin;

an elongated hollow mast extending within said chamber and having its upper end spaced below the upper end of said canister;

a mounting member on he upper end of said mast;

a coaxial cable extending into said hollow mast to provide radio signals to said antenna assembly;

four antenna members of resiliently deflectable wire spaced at 90 degree intervals about the periphery of said mounting member, and each comprising a generally helical coil mounted on said mounting member and elongate arms extending downwardly along the periphery of said mounting member and along the inner wall of said canister, opposed pairs of said antenna members comprising dipoles;

first and second baluns comprising a pair connected to said coaxial cable and disposed adjacent said mounting member;

a phase shifter connected between said coaxial cable and one of said baluns;

a pair of first connectors, each first connector conductively connecting a core conductor of one of the baluns to the coil of one of the antenna membes of a respective dipole;

a pair of second connectors, each second connector conductively connecting a conductive shield of one of the baluns to the coil of the other antenna member of the respective dipole; and sealing means about said first and second baluns and phase shifter, the coils of said antenna members being flexed when said arms are in the downwardly extending position within said canister, said canister being slidable relative to said mast and antenna members to free said arms therefrom for extension into a horizontal position.

2. The antenna assembly in accordance with claim 1, wherein each of said first and second baluns comprises, seriatim, a core conductor, an insulating layer, a conductive shield, an insulating layer, and an outer conductive layer extending over a portion of the length thereof, said outer conductive layer being conductively bonded to said conductive shield at a point spaced from a feed to said conductive shield a distance equivalent to about ¼ the effective wavelength for the intended radio transmissions.

3. The antenna assembly in accordance with claim 1 wherein said antenna assembly includes canister removal means for projecting said canister upwardly to release said arms for movement into the horizontal position.

4. The antenna assembly in accordance with claim 3 wherein said canister removal means comprises a discharge element within said canister actuatable upon receipt of a signal, and a signal conductor connected thereto.

5. The antenna assembly in accordance with claim 1 wherein said sealing means includes a substantially impervious synthetic resin coating a plurality of elements of said antenna assembly.

6. The antenna assembly in accordance with claim 1 wherein each of said first and second baluns are supported away from said mounting member.

7. The antenna assembly in accordance with claim 6 wherein the second connectors are secured to said mounting member.

8. The antenna assembly in accordance with claim 1 wherein said mounting member has apertures therein providing passages for said first and second connectors.

9. The antenna assembly in accordance with claim 8 wherein said apertures have a metallic surface therabout and said second connector are metallurgically bonded thereto and a connector means extend therefrom to said coils.

10. The antenna assembly in accordance with claim 1 wherein said baluns include a coaxial cable in which said conductive shield is a tubular metallic element extending thereabout, and wherein a second conductive layer is a metallic tape spaced from said tubular metallic element by an insulating sleeve.

11. The antenna assembly in accordance with claim 1 wherein said phase shifter is a length of coaxial cable disposed in a U-shaped configuration.

12. A deployable antenna assembly comprising:

a canister providing an elongated chamber therewithin;

an elongated hollow mast extending within said chamber and having its upper end spaced below the upper end of said canister;

a mounting member on he upper end of said mast;

a first coaxial cable extending into said hollow mast to provide radio signals to said antenna assembly;

four antenna members of resiliently deflectable wire spaced at 90 degree intervals about the periphery of said mounting member, and each comprising a generally helical coil mounted on said mounting member and elongate arms extending downwardly along the periphery of said mounting member and along the inner wall of said canister, opposed pairs of said antenna members comprising dipoles;

a pair of baluns connected to said coaxial cable and disposed adjacent said mounting member, each of said baluns comprising, seriatim, a core conductor, an insulating layer, a conductive shield, an insulating layer, and an outer conductive layer extending over a portion of the length thereof, said outer conductive layer being conductively bonded to said conductive shield at a point spaced from a feed to said conductive shield a distance equivalent to about ¼ the effective wavelength for the intended radio transmissions, said conductive shield is a tubular metallic element, and wherein said outer conductive layer is a metallic tape spaced from said tubular metallic element by an insulating sleeve;

a phase shifter connected between said coaxial cable and one of said baluns, said shifter comprising a length of a second coaxial cable disposed in a U-shaped configuration;

a pair of first connectors, each first conenctor conductively connecting the core of one of the baluns to the coil of one of the antenna members of a respective dipole;

a pair of second connectors, each second connector conductively connecting the conductive shield of one of the baluns to the coil of the other antenna member of the respective dipole;

sealing means about said baluns and phase shifter; and canister removal means for projecting said canister upwardly to release said elongate arms for movement into a horizontal position, the coils of said antenna members being flexed when said elongate arms are in the downwardly extending position within said canister, said canister being slidable relative to said mast and said antenna members to free said arms therefrom for extension into said horizontal position.

13. The antenna assembly in accordance with claim 12 wherien said canister removal means comprises a discharge element within said canister actuatable upon reeipt of a signal, and a signal conductor connected thereto.

14. The antenna assembly in accordance with claim 12 wherien said sealing means includes a substantially impervious synthetic resin coating about a plurality of elements of said antenna assembly.

15. The antenna assembly in accordance with claim 12 wherein said first and second baluns are supported away from said mounting member.

16. The antenna assembly in accordance with claim 12 wherein the second connectors are secured to said mounting member.

17. The antenna assembly in accordance with claim 12 wherein said mounting member has apertures therein providing passages for said first and second connectors.

18. The antenna assembly in accordance with claim 17 wherein said apertures have a metallic surface thereabout and said second connectors are metallurgically bonded thereto and a connector means extend therefrom to said coils.

* * * * *